US006953221B1

(12) United States Patent
Tseng et al.

(10) Patent No.: US 6,953,221 B1
(45) Date of Patent: Oct. 11, 2005

(54) FOLDABLE CHAIR

(76) Inventors: Kail Tseng, 425 Hampton Ave., Monterey Park, CA (US) 91754; Chih Yuan Lai, 25 Hampton Ave., Monterey Park, CA (US) 91754

( * ) Notice: Subject to any disclaimer, the term of this patent is extended or adjusted under 35 U.S.C. 154(b) by 0 days.

(21) Appl. No.: 10/915,585

(22) Filed: Aug. 9, 2004

(51) Int. Cl.[7] ..... A47C 3/04; A47C 4/04
(52) U.S. Cl. ..... 297/23; 297/58; 297/59; 297/239
(58) Field of Search ..... 297/23, 239, 58, 297/59

(56) References Cited

U.S. PATENT DOCUMENTS 5,328,232 A * 7/1994 Whitehead ..... 297/58
6,099,073 A * 8/2000 Bruschi ..... 297/59
6,863,341 B1 * 3/2005 Wen ..... 297/23
6,890,026 B1 * 5/2005 Shin ..... 297/58 X

* cited by examiner

*Primary Examiner*—Rodney B. White
(74) *Attorney, Agent, or Firm*—Raymond Y. Chan; David and Raymond

(57) ABSTRACT

A foldable chair includes a chair frame and a seat frame. The chair frame includes two spaced apart front legs, two spaced apart rear legs pivotally connected to the two front legs respectively, and a supporting member transversely extended between the two rear legs and having a bottom inclined engaging side. The chair frame is adapted to pivotally fold between an unfolded position and a folded position. The seat frame includes two seat arms pivotally connected to the front legs respectively, a seat platform provided between the two seat arms, and a retention arm which is transversely extended between two seat arms and has a corresponding upper inclined retention side.

14 Claims, 7 Drawing Sheets

FOLDABLE CHAIR

BACKGROUND OF THE PRESENT INVENTION

1. Field of Invention

The present invention relates to a chair, and more particularly to a foldable chair which facilitates a more optimal folding operation with enhanced structural strength and stability so as to impart maximum convenience and comfort to a user of the present invention.

2. Description of Related Arts

Referring to FIG. 1 to FIG. 2 of the drawings, a conventional foldable chair usually comprises a front leg frame 10P, a rear leg frame 20P pivotally connected with the front leg frame 10P, and a seat frame 30P foldably supported by the front and the rear leg frame 10P, 20P in such a manner that it is capable of moving between a folded position and an unfolded position, wherein in the unfolded position, the front and the rear leg frames 10P, 20P are pivotally extended to support the seat frame 30P in a horizontal manner and to securely stand on a ground surface, wherein in the folded position, the front leg frame 10P, the rear leg frame 20P and the seat frame 30P are pivotally and overlappedly folded towards each other to form a compact structure.

The rear leg frame 20P comprises two spacedly apart rear legs 21P for standing on the ground surface, and a reinforcing bar 22P transversely extended between the two rear legs 21P. On the other hand, the seat frame 30P comprises a rear stacking lip 31P, having an engaging surface 311P, outwardly extended therefrom to form a substantially right angle shape, wherein when the seat frame 30P is in the unfolded position, the rear stacking lip 31P is pivotally moved such that the engaging surface 311P engages and interlocks with the reinforcing bar 22P so as to securely retain the seat frame 30P in position. When a user is sitting on the foldable chair, the reinforcing bar 22P is arranged to provide reinforcing support to the downward force applied to the seat frame 30P, as shown in FIG. 2 of the drawings.

Moreover, when the seat frame 30P is in the folded position, it is pivotally folded in an upright manner such that the rear stacking lip 31P is outwardly and transversely extended from the seat frame 30P. Referring to FIG. 2 of the drawings, when the seat frame 30P is in the folded position, the rear stacking lip 31P is adapted to fittedly stack with another foldable chair so as to facilitate convenient and easy storage. It is worth noting that such a conventional foldable chair is also disclosed in U.S. Pat. No. 6,592,182 of Noor. Furthermore, the seat frame 30P may comprise a stacking guider 33P protruded from a bottom side thereof to receive in the cavity formed between the seat frame 30P and the rear leg frame 20P of another foldable chair so as to prevent lateral movement of the two chairs in question.

Such a conventional foldable chair has several disadvantages. First of all, when the rear stacking lip 31P is interlocked with the reinforcing bar 22P of the rear leg frame 30P, i.e. when the seat frame 30P is in the unfolded position, the engagement between the engaging surface 311P and the reinforcing bar 22P may not be fittedly accomplished such that there exist a substantial gap between the reinforcing bar 22P and the rear stacking lip 31P which may cause uncomfortableness to the user. Specifically, the pant and the clothes of the user may be accidentally trapped within the gap, and when the user stands up from the foldable chair, his/her clothes/pant may be stretched.

In order to securely support the seat frame 30P on the front and the rear leg frame 10P, 20P, the seat frame further comprises a pivot rod 32P transversely extended across two opposite side edges underneath the seat frame 30P for pivotally connecting the seat frame 30P with the front leg frame 10P. This has a disadvantage that the pivot rod 32P would usually be seriously deflected after a prolonged use of the foldable chair, so that the pivotal folding and folding movement of the seat frame 30P may be affected, and that the overall stability and rigidity of the foldable chair would be deteriorated. When the deflection is too serious, the user may even needs replacement of the chair for safety reason.

SUMMARY OF THE PRESENT INVENTION

A main object of the present invention is to provide a foldable chair which facilitates optimal folding with enhanced structural strength and stability so as to impart maximum convenience and comfort to a user of the present invention.

Another object of the present invention is to provide a foldable chair comprising a supporting member extended between two rear legs, wherein the supporting member is adapted to fittedly engage with a seat frame when it is in an unfolded position, such that there does not exist a substantial gap between the supporting member and the seat frame.

Another object of the present invention is to provide a foldable chair with enhanced pivotal mounting between the seat frame and the rear legs so as to maximize the product life span of the present invention.

Another object of the present invention is to provide a foldable chair comprising a stacking arrangement which allows a user of the present invention to conveniently, compactly and securely stack two or more foldable chairs in order when they are not in use.

Another object of the present invention is to provide a foldable chair which does not involve complicated and expensive components so as to minimize the manufacturing cost and the ultimate selling price of the present invention.

Accordingly, in order to accomplish the above objects, the present invention provides a foldable chair, comprising:

a chair frame comprising two spaced apart front legs, two spaced apart rear legs pivotally connected to the two front legs respectively, and a supporting member transversely extended between the two rear legs and having a bottom inclined engaging side, wherein the chair frame is adapted to pivotally fold between an unfolded position and a folded position; and a seat frame comprising two seat arms pivotally connected to the front legs respectively, a seat platform provided between the two seat arms, and a retention arm which is transversely extended between two seat arms and has a corresponding upper inclined retention side, wherein at the unfolded position, bottom ends of the rear legs are outwardly folded apart from bottom ends of the front legs such that the seat frame is pivotally folded in a horizontal manner to engage the retention side of the retention arm with the engaging side of the supporting member so as to retain a distance between the front and rear legs, and at the folded position, the retention side of the retention arm is disengaged with the engaging side of the supporting member such that the front legs are pivotally folded to overlap with the rear legs to form a compact structure.

These and other objectives, features, and advantages of the present invention will become apparent from the following detailed description, the accompanying drawings, and the appended claims.

DETAILED DESCRIPTION OF THE PREFERRED EMBODIMENT

Figure 1:
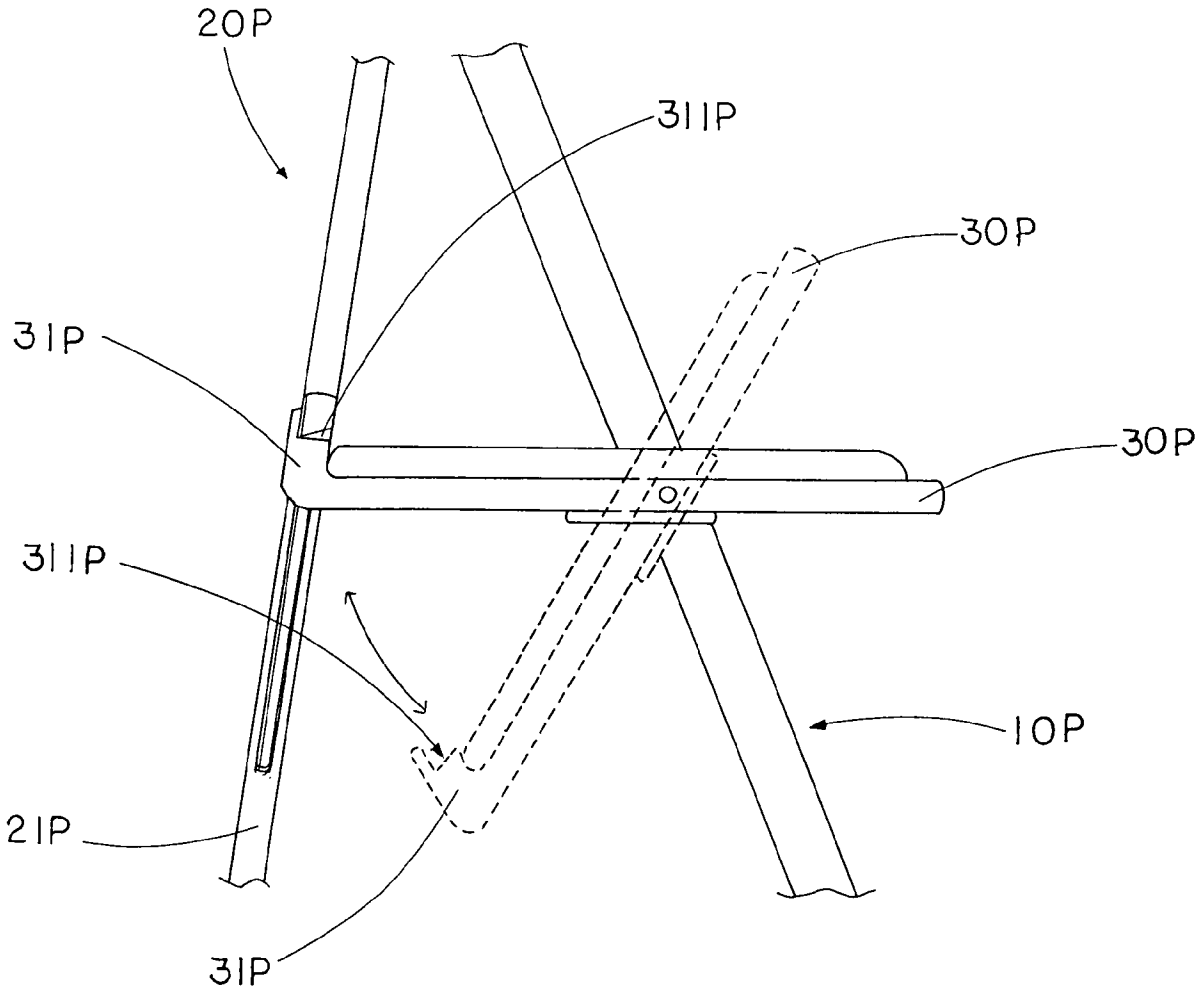
FIG 1 PRIOR ART
FIG. 1 is a side view of the conventional foldable chair.
Figure 2:
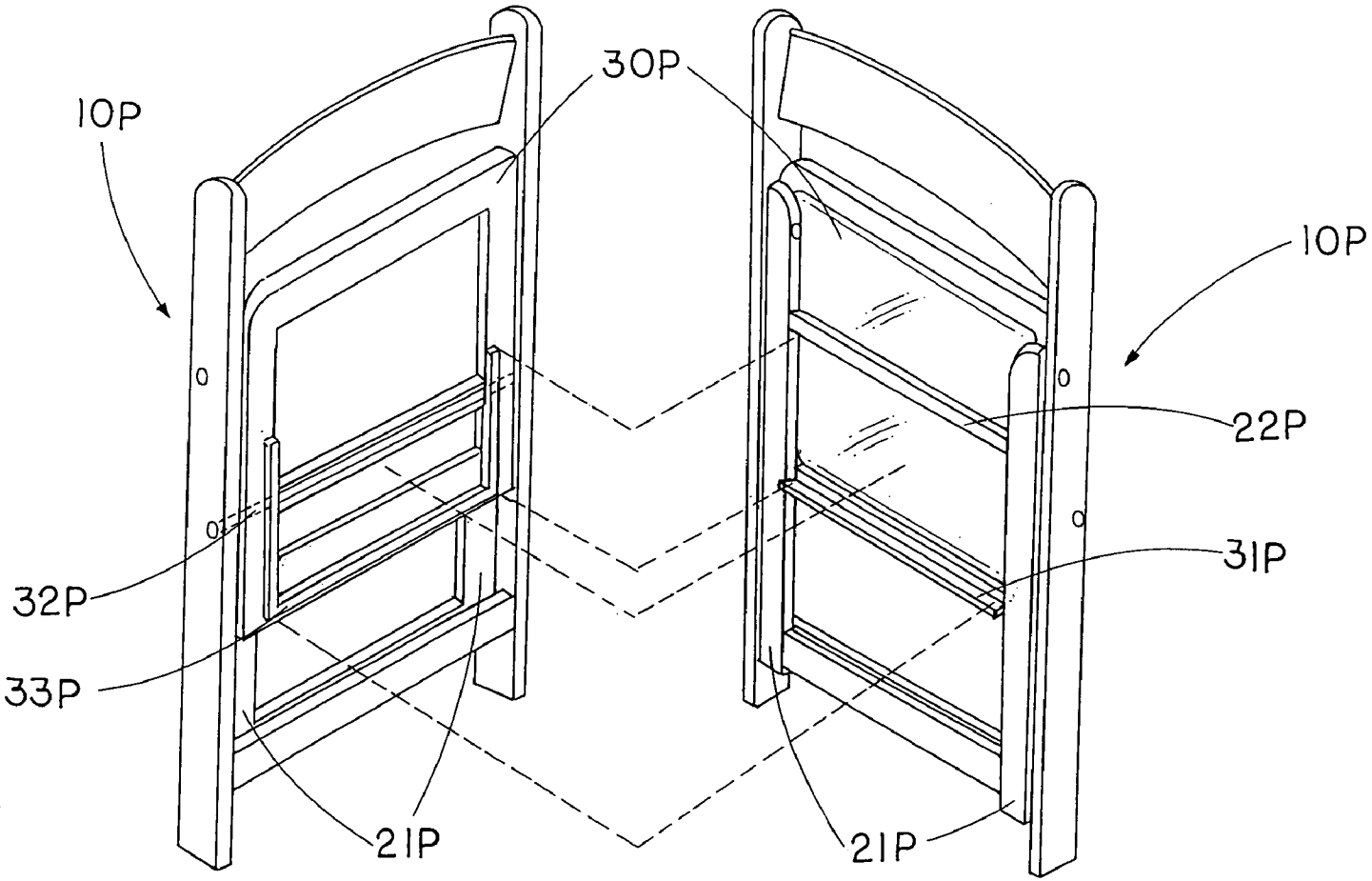
FIG. 2 PRIOR ART
FIG. 2 is a schematic diagram of the two conventional foldable chairs.
Figure 3:
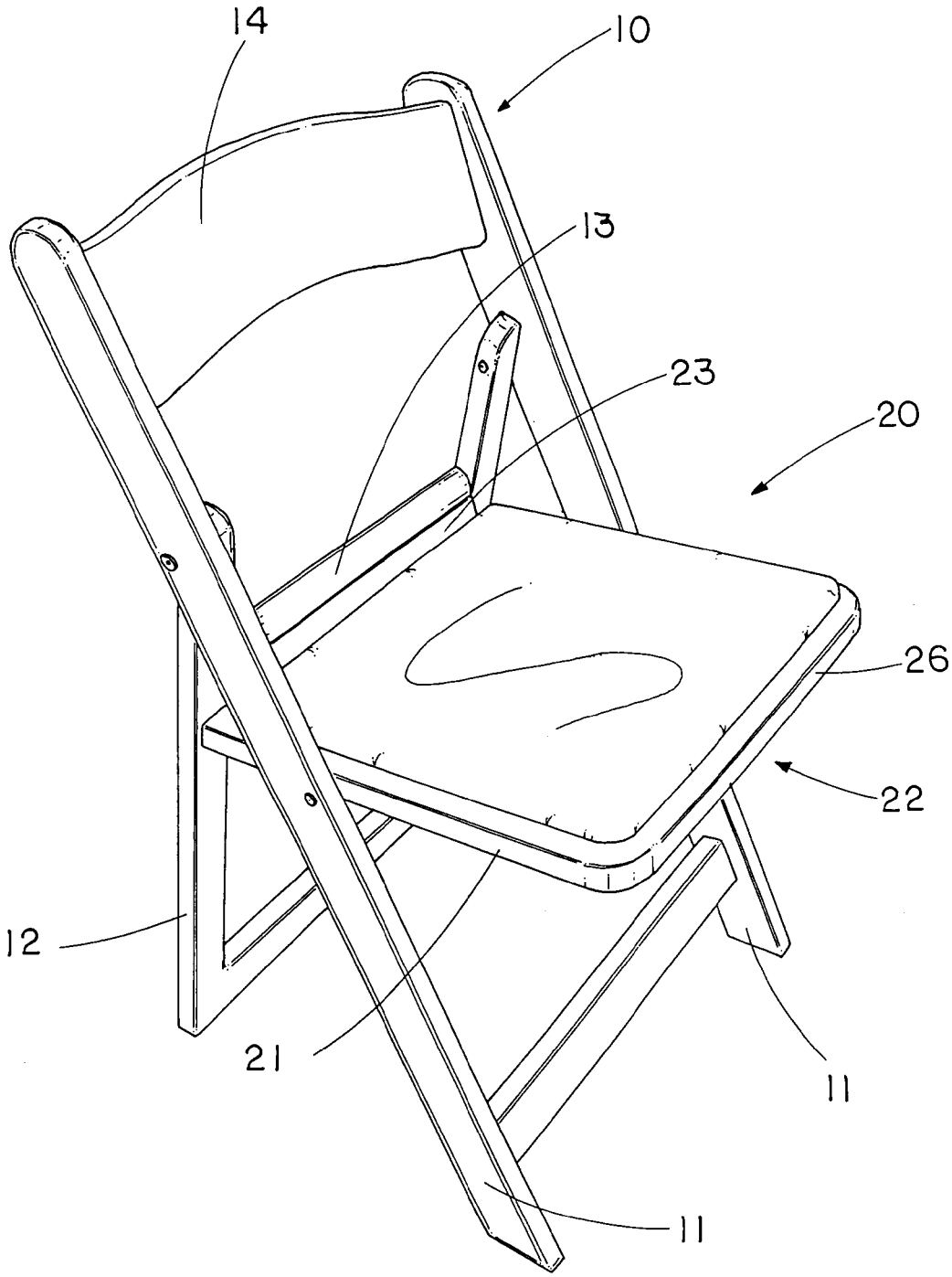
FIG. 3 is a perspective view of a foldable chair according to a preferred embodiment of the present invention.

Referring to FIG. 3 of the drawings, a foldable chair according to a preferred embodiment of the present invention is illustrated, in which the foldable chair comprises a chair frame 10 and a seat frame 20.

The chair frame 10 comprises two spacedly apart front legs 11, two spacedly apart rear legs 12 pivotally connected to the two front legs respectively, and a supporting member 13 transversely extended between the two rear legs 12. The supporting member 13 has a bottom inclined engaging side 131, in which the chair frame 10 is adapted to pivotally folded between an unfolded position and a folded position.

The seat frame 20 comprises two seat arms 21 pivotally connected to the front legs 11 respectively, a seat platform 22 provided between the two seat arms 21, and a retention arm 23 transversely extended between the two seat arms 21 and has a corresponding upper inclined retention side 231.

Figure 4A:
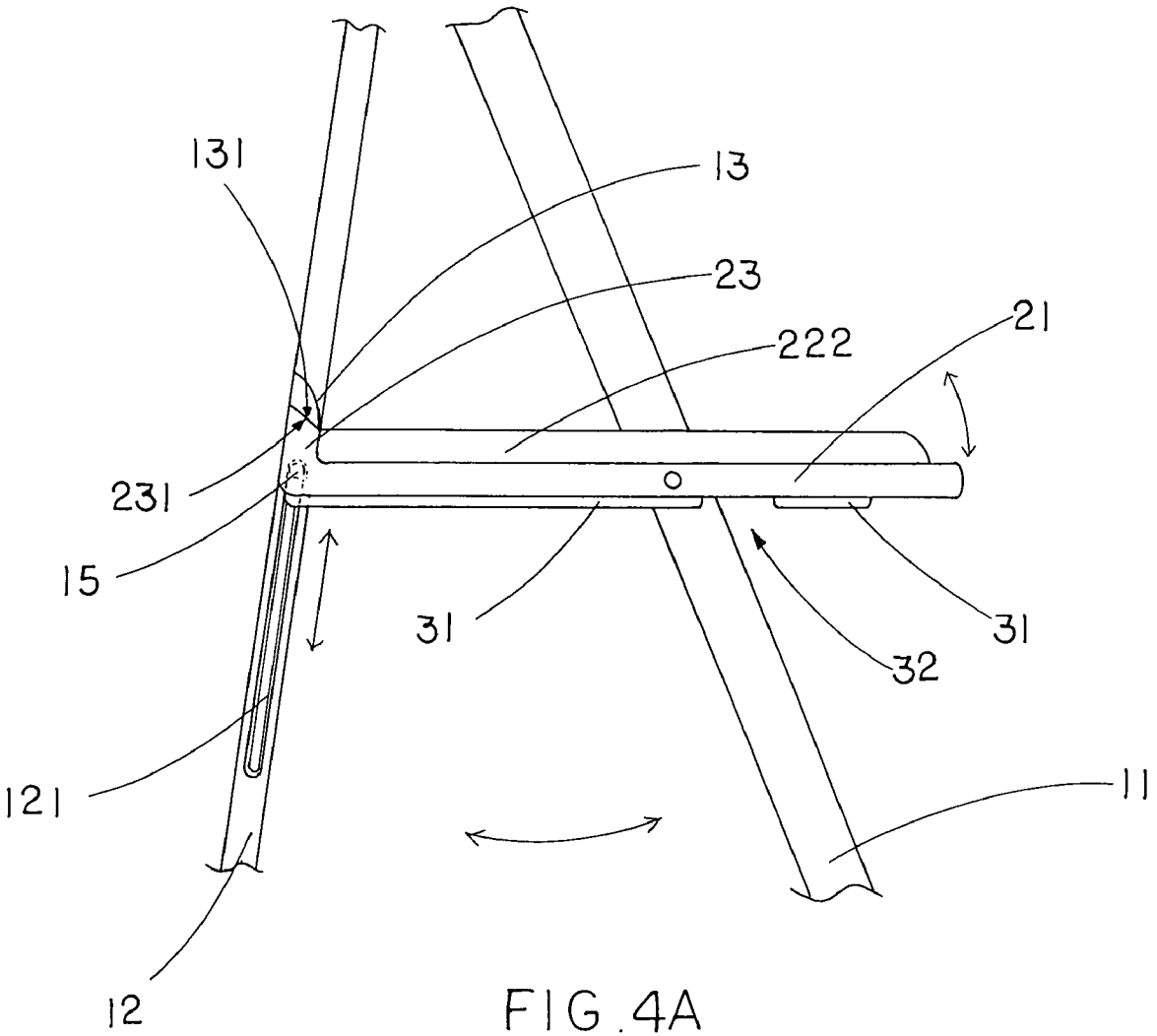
FIG. 4A and FIG. 4B are side views of the foldable chair according to the above preferred embodiment of the present invention.
Figure 4B:
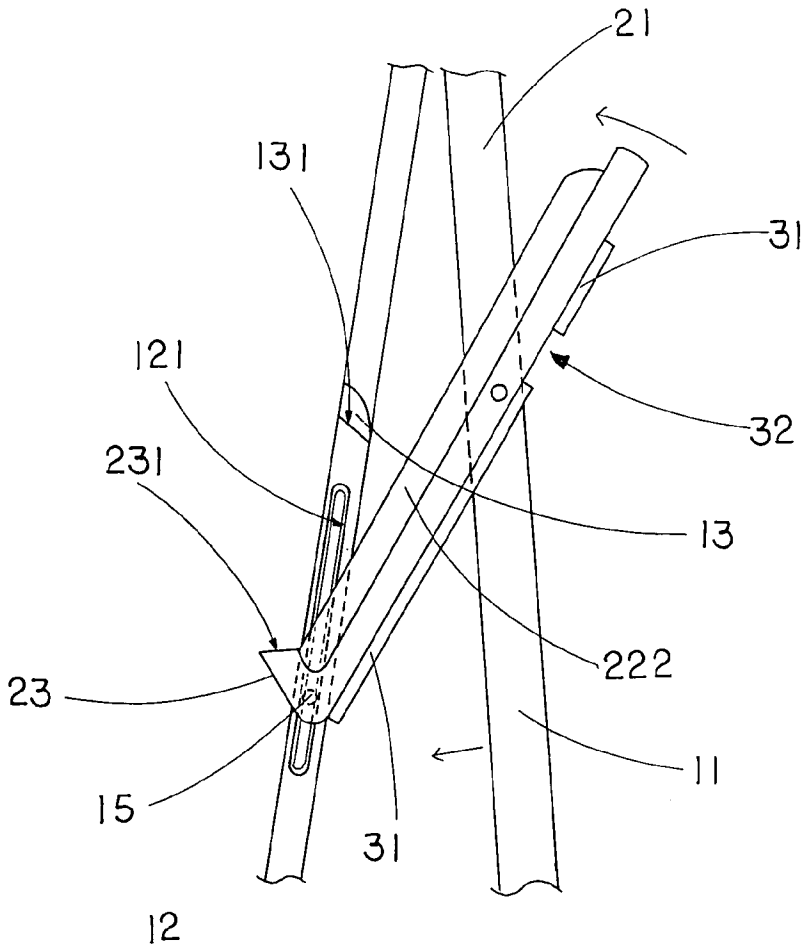

Referring to FIG. 4A and FIG. 4B of the drawings, when the chair frame 10 is in the unfolded position, bottom ends of the rear legs 12 are outwardly folded apart from bottom ends of the front legs 11 such that the seat frame 20 is pivotally moved in a horizontal manner to engage the retention side 231 of the retention arm 23 with the engaging side 131 of the supporting member 13 so as to retain a distance between the front legs 11 and the rear legs 12. Conversely, when the chair frame 10 is in the folded position, the retention side 231 of the retention arm 23 is disengaged with the engaging side 131 of the supporting member 13 such that the front legs 11 and the seat frame 20 are pivotally folded to overlap with the rear legs 12 to form a compact structure for convenient storage.

According to the preferred embodiment, the retention arm 23 is integrally and transversely extended between two rear ends of the seat arms 21 wherein the upper retention side 231 is outwardly and upwardly protruded therefrom to engage with the bottom engaging side 131 of the supporting member 13. Moreover, the seat frame 20 further comprises a front sustaining member 26 integrally extended from two front ends of the seat arms 21 to define a rectangular boundary frame between the seat arms 21, the retention arm 23 and the sustaining member 26.

As shown in FIG. 4A, FIG. 4B of the drawings, each of the rear legs 12 further has an elongated sliding slot 121 formed on an inner side thereof wherein two ends of the retention arm 23 are sildably mounted along the respective sliding slot 121 in such a manner that when the chair frame is pivotally moved between the folded position and the unfolded position, the retention arm 23 is moved accordingly and substantially guided by the sliding slot 121 to engage and disengage with the supporting member 13.

The upper retention side 231 of the retention arm 23 is downwardly and frontwardly inclined at a predetermined angle, whereas the bottom engaging side 131 of the supporting member 13 is upwardly and rearwardly inclined at a predetermined angle to align with the upper retention side 231 in such a manner that when the chair frame 10 is in the unfolded position, the engaging side 131 and the retention side 231 are fittedly and alignedly engaged and interlocked with each other so as to minimize a gap therebetween in order to avoid unwanted trapping of the user's clothes or pant when he/she is sitting on the seat frame 20.

Furthermore, the supporting member 131 has a curved front side 132 aligning with a front side of the retention arm in an edge to edge manner at the unfolded position so as to further minimize a gap between the supporting member 13 and said retention arm 23. Thus, it can easily be appreciated that the user of the present invention is able to minimize hassles from possible damage to his/her clothes/pant as though when he/she is sitting in a conventional foldable chair.

The seat platform 22 is supported by the boundary frame for a user seating thereon, and comprises a rigid supporting base 221 and a seat fabric 222 attached on top thereof to provide a cushioning effect of the seat platform 22.

Figure 6:
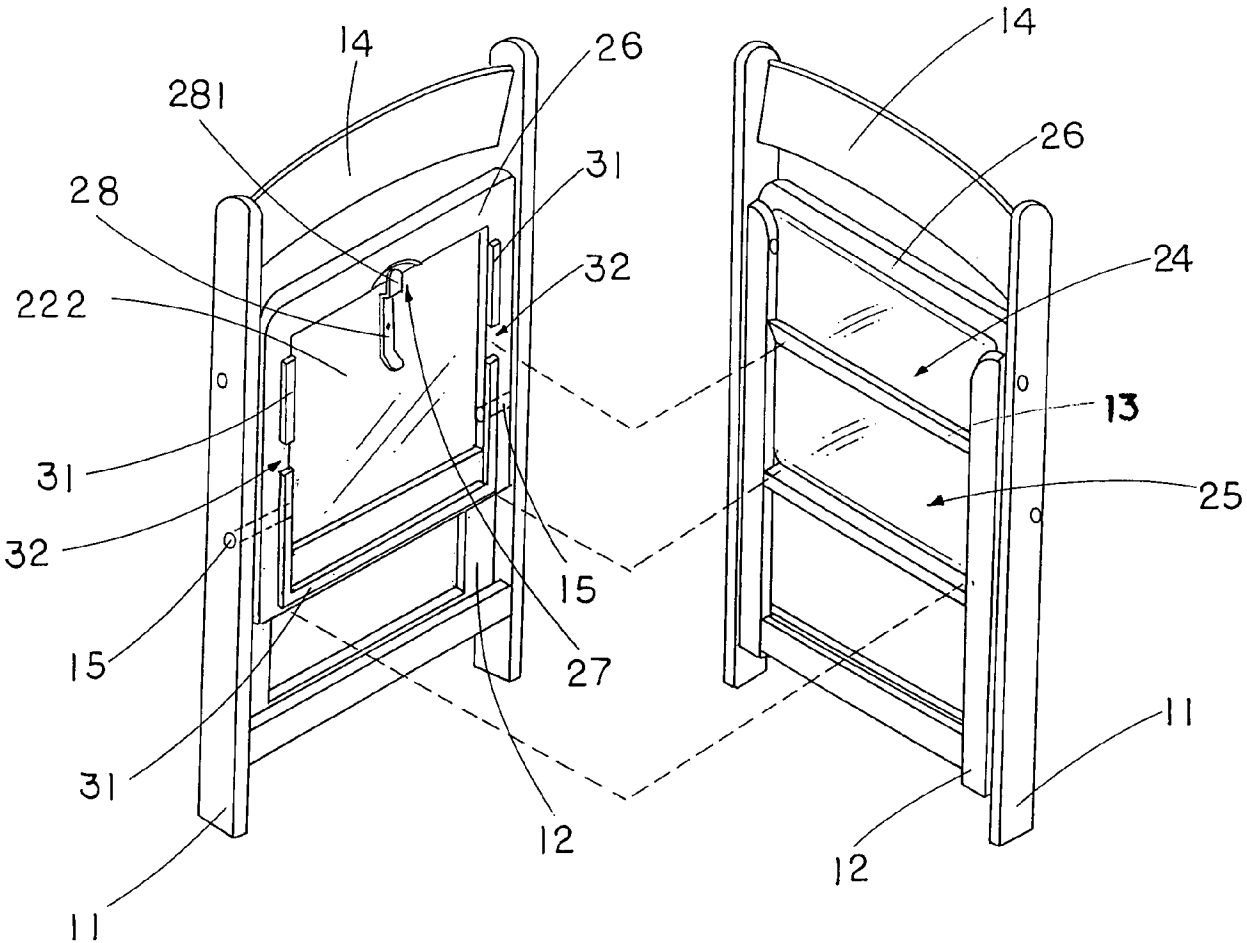
FIG. 6 is a schematic diagram of the foldable chair according to the above preferred embodiment of the present invention.

Referring to FIG. 6 of the drawings, it can be shown that when the chair frame 10 is in the folded position, the seat platform 22 and the rear legs 12 are overlappedly folded to form a upper stacking compartment 24 within a front side of the seat fabric 222 and the two rear legs 12, and a lower stacking compartment 25 within the front side of the seat fabric 222 and the two rear legs 12. Accordingly, a thickness of the rear legs 12 constitutes a depth of the upper stacking compartment 24 and the lower stacking compartment 25.

The foldable chair further comprises two stacking arrangements 30 downwardly extended from bottom sides of the two seat arms 21 respectively, wherein each of the stacking arrangements 30 comprises two elongated stacking guiders 31 spacedly and alignedly provided at the respective seat arm 21 to form a stacking slot 32 having a width slightly larger than a width of the supporting member 13, thereby, when two of the foldable chairs are overlappedly stacked with each other, the supporting member 13 pf one of the foldable chair is received at the stacking slot 32 of another foldable chair so as to interlock the two foldable chair with each other in a stable manner.

In other words, the stacking guiders 31 are protruded from a bottom side of the seat arms 21 respectively and adapted to be peripherally received in the upper stacking compartment 24 and the lower stacking compartment 25 of another foldable chair so that two foldable chairs of the present invention, when folded, can be stacked with each other with minimum spatial occupation. Therefore, a depth of each of the stacking guiders 31 substantially equals to the depth of the upper stacking compartment 24 and the lower stacking compartment 25 so as to minimize a gap between the two foldable chairs.

It is also worth mentioning that a distance between the two opposing stacking guiders 31 of the respective stacking arrangements 30 is slightly smaller than a distance between the two front legs 11, thereby when two of the foldable chairs are overlappedly stacked with each other, the four stacking guiders are received at two inner side of the four front legs 11 so as to prevent the lateral movement between the two foldable chairs so as to secure a safe stacking practice when they are not in use.

As shown in FIG. 6 of the drawings, in order to further enhance the security and reliability of the stacking arrangement, at least one of the stacking guiders 31 is also formed on a bottom side of the retention member 23 and extended therealone to integrally connect to two the elongated stacking guiders 31 of the side arms 21 to form a U-shaped stacking guider 31, wherein this U-shaped stacking guider 31 is adapted to receive in the lower stacking compartment 25 during stacking so as to substantially prevent a lateral movement between two foldable chairs of the present invention.

Figure 5:
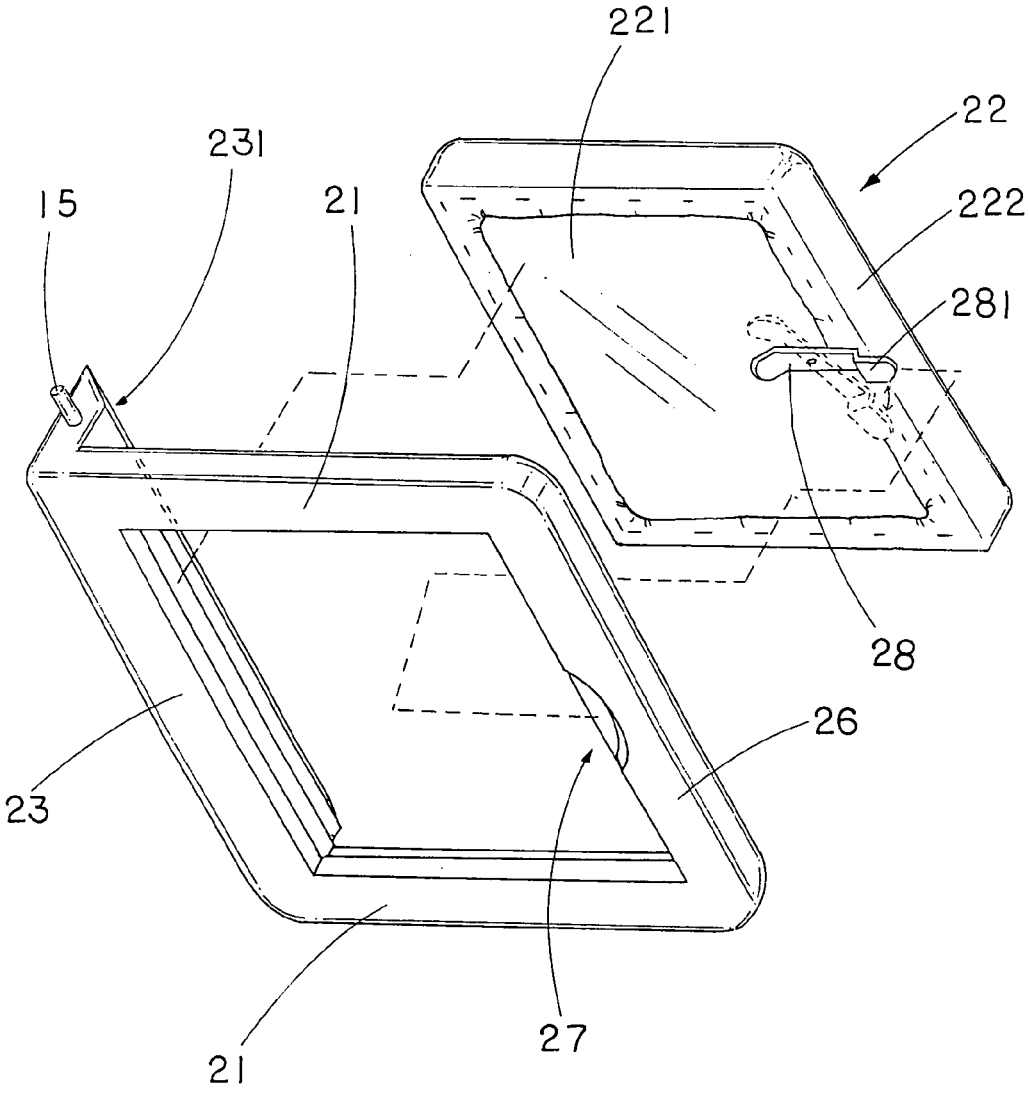
FIG. 5 is an exploded perspective view of the locking arrangement according to the above preferred embodiment of the present invention.

Referring to FIG. 5 of the drawings, the seat frame 20 further comprises a locking arrangement for detachably locking the seat platform 22 on the boundary frame, wherein the locking arrangement has a locking cavity 27 formed at a bottom side of the front sustaining member 26, and comprises a locker arm 28 pivotally mounted on a bottom side of the seat platform 22 such that when the seat platform 22 is supported on the boundary frame at a position that a rear edge of the seat platform 22 is biased against the retention arm 23, a locking end 281 of the locker arm 28 is pivotally slid into the locking cavity 27 to restrict an upward movement of the seat platform 22 with respect to the boundary frame so as to lock up the seat platform 22 on the boundary frame.

Thus, the locking end 281 of the locker arm 28 is adapted to pivotally move into the locking cavity 27 for aligning with a top ceiling thereof so as to restrict an upward movement of the seat platform 22.

On the other hand, the rigid supporting base 221 is shaped and sized to correspond with the boundary frame such that when the rigid supporting base 221 is being supported thereon, the pivot arm 223 of the seat platform 22 is adapted to pivotally move into the securing slot 261 for restricting an upward movement of the seat platform 22, while a sideward and a rearward movement thereof is substantially blocked by the two seat arms 21 and the upwardly protruded retention member 23 respectively.

It is worth to mention that the seat platform 22 can be constructed to permanently affixed to the chair frame 10 without detaching the seat platform 22 from the chair frame. In other words, the seat platform 22 can be integrally extended within the two seat arms 21, the front sustaining member 26 and the retention arm 23 wherein the front edge of the seat platform 22 can be embodied as the front sustaining member 26, the rear edge of the seat platform 22 can be embodied as the retention arm 23 and the two side edges of the seat platform 22 can be embodied as the two seat arms 21 respectively.

Referring to FIG. 6 of the drawings, the seat arms 21 are pivotally connected with the front legs 11 respectively through a plurality of pivot shafts 15. In other words, compared with the above-mentioned conventional arts, it should be stressed that there is no need to pivotally connect the seat arms 21 with the front legs 11 through some forms of pivot rods (32P) which extends across the two seat arms 21. Therefore, the disadvantage that this pivot rod (32P) would be seriously deflected to cause possible fracture simply does not exist.

In other words, the two pivot shafts 15 are capable of enhancing a strength of the seat arms 21 to support the seat platform 22 therebetween for substantially distributing a downward loading force on the seat platform 22 towards the chair frame 10.

It is also noteworthy that in order to overlappedly fold the chair frame 10 into the folded position, a transverse distance between the rear legs 12 must be smaller than a distance between the front legs 11. When the chair frame 10 is in the folded position, the rear legs 12 are pivotally folded to receive in between the front legs 11.

The chair frame 10 further comprises a back support 14 transversely extended between two upper portions of the front legs 11 for supporting a back portion of the user when he/she is sitting on the foldable chair. The back support 14 is preferably embodied as a supporting panel which is ergonomically sized and shaped to fit a body profile of the user's back. Thus, the back support 14 is adapted to optimally support the user with maximum comfort.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable chair, comprising:

a chair frame comprising two spaced apart front legs, two spaced apart rear legs pivotally connected to said two front legs respectively, and a supporting member transversely extended between said two rear legs and having a bottom inclined engaging side upwardly and rearwardly inclined at a predetermined angle, wherein said chair frame is adapted to pivotally fold between an unfolded position and a folded position; and a seat frame comprising two seat arms pivotally connected to said front legs respectively, a seat platform provided between said two seat arms, and a retention arm which is transversely extended between two seat arms and has a corresponding upper inclined retention side downwardly and frontwardly inclined at said predetermined angle to substantially align with said upper retention side of said retention arm;

wherein at said unfolded position, said seat frame is pivotally folded in a horizontal manner until said retention side of said retention arm is alignedly engaged with said engaging side of said supporting member to retain a distance between said front and rear legs that bottom ends of said rear legs are outwardly folded apart from bottom ends of said front legs respectively, and at said folded position, said seat frame is pivotally folded to disengage said retention side of said retention arm with said engaging side of said supporting member such that said front legs are pivotally folded to overlap with said rear legs to form a compact structure.

2. The foldable chair, as recited in claim 1, wherein said supporting member has a curved front side aligning with a front side of said retention arm in an edge to edge manner such that when said retention side of said retention arm is engaged with said engaging side of said supporting member, said curved front side of said supporting member is extended from said front side of said retention arm to minimize a gap between said supporting member and said retention arm.

3. The foldable chair, as recited in claim 2, further comprising two stacking arrangements downwardly extended from bottom sides of said two seat arms respectively, wherein each of said stacking arrangements comprises two elongated stacking guiders spacedly and alignedly provided at said respective seat arm to form a stacking slot having a width slightly larger than a width of said supporting member, wherein said foldable chair is adapted to overlappedly stack with another said foldable chair when said supporting member of said foldable chair is received at said stacking slots of another said foldable to interlock said two foldable chairs with each other in a stable manner.

4. The foldable chair, as recited in claim 3, wherein a distance between said two opposing stacking guiders of said stacking arrangements is slightly smaller than a distance between said two front legs, wherein said foldable chair is adapted to overlappedly stack with another said foldable chair when said four stacking guiders are received at two inner sides of said front legs for preventing a lateral movement between said two foldable chairs.

5. The foldable chair, as recited in claim 4, wherein said seat frame further comprises a front sustaining member extended between two front ends of said seat arms to form a boundary frame to detachably support said seat platform thereon and a locking arrangement for detachably locking said seat platform on said boundary frame, wherein said locking arrangement has a locking cavity formed at a bottom side of said front sustaining member and comprises a locker arm pivotally mounted on a bottom side of said seat platform such that when said seat platform is supported on said boundary frame at a position that a rear edge of said seat platform is biased against said retention arm, a locking end of said locker arm is pivotally slid into said locking cavity to restrict an upward movement of said seat platform with respect to said boundary frame so as to lock up said seat platform on said boundary frame.

6. The foldable chair, as recited in claim 5, further comprising two pivot shafts outwardly extended from two sides of said seat arms respectively, wherein each of said rear legs further has an elongated sliding slot formed on an inner side thereof, wherein said two pivot shafts are slidably engaged with said sliding slots to guide said seat frame pivotally folding at said unfolded position until said retention side of said retention arm is alignedly engaged with said engaging side of said supporting member.

7. The foldable chair, as recited in claim 4, further comprising two pivot shafts outwardly extended from two sides of said seat arms respectively, wherein each of said rear legs further has an elongated sliding slot formed on an inner side thereof, wherein said two pivot shafts are slidably engaged with said sliding slots to guide said seat frame pivotally folding at said unfolded position until said retention side of said retention arm is alignedly engaged with said engaging side of said supporting member.

8. The foldable chair, as recited in claim 3, wherein said seat frame further comprises a front sustaining member extended between two front ends of said seat arms to form a boundary frame to detachably support said seat platform thereon and a locking arrangement for detachably locking said seat platform on said boundary frame, wherein said locking arrangement has a locking cavity formed at a bottom side of said front sustaining member and comprises a locker arm pivotally mounted on a bottom side of said seat platform such that when said seat platform is supported on said boundary frame at a position that a rear edge of said seat platform is biased against said retention arm, a locking end of said locker arm is pivotally slid into said locking cavity to restrict an upward movement of said seat platform with respect to said boundary frame so as to lock up said seat platform on said boundary frame.

9. The foldable chair, as recited in claim 3, further comprising two pivot shafts outwardly extended from two sides of said seat arms respectively, wherein each of said rear legs further has an elongated sliding slot formed on an inner side thereof, wherein said two pivot shafts are slidably engaged with said sliding slots to guide said seat frame pivotally folding at said unfolded position until said retention side of said retention arm is alignedly engaged with said engaging side of said supporting member.

10. The foldable chair, as recited in claim 2, wherein said seat frame further comprises a front sustaining member extended between two front ends of said seat arms to form a boundary frame to detachably support said seat platform thereon and a locking arrangement for detachably locking said seat platform on said boundary frame, wherein said locking arrangement has a locking cavity formed at a bottom side of said front sustaining member and comprises a locker arm pivotally mounted on a bottom side of said seat platform such that when said seat platform is supported on said boundary frame at a position that a rear edge of said seat platform is biased against said retention arm, a locking end of said locker arm is pivotally slid into said locking cavity to restrict an upward movement of said seat platform with respect to said boundary frame so as to lock up said seat platform on said boundary frame.

11. The foldable chair, as recited in claim 1, further comprising two stacking arrangements downwardly extended from bottom sides of said two seat arms respectively, wherein each of said stacking arrangements comprises two elongated stacking guiders spacedly and alignedly provided at said respective seat arm to form a stacking slot having a width slightly larger than a width of said supporting member, wherein said foldable chair is adapted to overlappedly stack with another said foldable chair when said supporting member of said foldable chair is received at said stacking slots of another said foldable chair to interlock said two foldable chairs with each other in a stable manner.

12. The foldable chair, as recited in claim 11, wherein a distance between said two opposing stacking guiders of said stacking arrangements is slightly smaller than a distance between said two front legs, wherein said foldable chair is adapted to overlappedly stack with another said foldable chair when said four stacking guiders are received at two inner sides of said front legs for preventing a lateral movement between said two foldable chairs.

13. The foldable chair, as recited in claim 1, wherein said seat frame further comprises a front sustaining member extended between two front ends of said seat arms to form a boundary frame to detachably support said seat platform thereon and a locking arrangement for detachably locking said seat platform on said boundary frame, wherein said locking arrangement has a locking cavity formed at a bottom side of said front sustaining member and comprises a locker arm pivotally mounted on a bottom side of said seat platform such that when said seat platform is supported on said boundary frame at a position that a rear edge of said seat platform is biased against said retention arm, a locking end of said locker arm is pivotally slid into said locking cavity to restrict an upward movement of said seat platform with respect to said boundary frame so as to lock up said seat platform on said boundary frame.

14. The foldable chair, as recited in claim 1, further comprising two pivot shafts outwardly extended from two sides of said seat arms respectively, wherein each of said rear legs further has an elongated sliding slot formed on an inner side thereof, wherein said two pivot shafts are slidably engaged with said sliding slots to guide said seat frame pivotally folding at said unfolded position until said retention side of said retention arm is alignedly engaged with said engaging side of said supporting member.

* * * * *